United States Patent [19]

Phillips

[11] Patent Number: 4,725,163

[45] Date of Patent: Feb. 16, 1988

[54] APPARATUS FOR APPLYING LIQUID SURFACE SEALER

[75] Inventor: Emil Phillips, North Royalton, Ohio

[73] Assignee: North Shore Company, North Royalton, Ohio

[21] Appl. No.: 848,500

[22] Filed: Apr. 7, 1986

[51] Int. Cl.[4] ..... E01C 19/12

[52] U.S. Cl. ..... 404/101; 404/110

[58] Field of Search ..... 404/108, 110, 111, 101

[56] References Cited

U.S. PATENT DOCUMENTS

| | | | |
|---|---|---|---|
| 1,291,361 | 1/1919 | Babst | 404/108 |
| 3,515,041 | 6/1970 | Murtaugh | 404/108 |
| 4,507,012 | 3/1985 | Corcoran et al. | 404/110 X |

*Primary Examiner*—Carl D. Friedman

*Attorney, Agent, or Firm*—Pearne, Gordon, McCoy & Granger

[57] ABSTRACT

An apparatus for spreading and leveling liquid surface coatings used to seal bituminous surfaces. The apparatus includes the combination of a mobile hopper assembly for storing and dispensing the viscous coating material at a controlled rate in the form of globules or droplets along the path of travel of the hopper. The globules or droplets are spread and smoothed into a thin continuous coating by means of a spreading and leveling attachment pivotally connected to and adapted to be towed behind the hopper. The spreading and leveling attachment has a frame that carries flexible resilient spreading and smoothing blades. The spreading blade is mounted on the frame closely spaced from the surface to be coated and is adapted to spread and flatten the globules and droplets on the surface in both longitudinal and lateral directions. The smoothing blade is mounted behind the spreading blade and is engageable with the surface to smooth the viscous liquid into a thin and continuous coating.

3 Claims, 3 Drawing Figures

APPARATUS FOR APPLYING LIQUID SURFACE SEALER

BACKGROUND OF THE INVENTION

This invention relates to the application of liquid sealant to bituminous or other composition surfaces, such as driveways, walks, and the like. More particularly, the invention relates to equipment for use by a homeowner, for example, for applying liquid sealant such as a water-based asphaltic sealing compound that is initially in viscous liquid form to the surface, and especially to an attachment that may be used in conjunction with a garden and lawn spreader for granular fertilizer, seed, and the like, to spread and smooth the liquid that is initially loaded in the hopper of the spreader.

Driveways and walkways on both residential and commercial property in many parts of the country are formed of a bituminous composition comprising a mixture of an asphaltic compound and gravel, sand, or the like. While this material provides an excellent driveway and utility surface for many purposes, it requires a periodic application of a sealing compound (such as every two years). In the past, most of these sealants have been an oil-based asphaltic compound; however, in recent years, water-based compounds have become available. The sealant comes in the form of a viscous liquid that is normally applied with a broom, brush, mop, or other hand tool that requires frequent dipping into a container of the compound and spreading and smoothing the material manually over the entire surface to be sealed.

Since the sealing operation is preferably performed in hot weather, it is a difficult, laborious and time-consuming task, particularly for homeowners in residential areas who normally would not be able to justify the purchase of professional application machinery.

Nevertheless, the periodic sealing procedure is necessary since otherwise water penetrates through cracks and holes and in cold weather expands and breaks up the surface.

The apparatus of the present invention simplifies the sealing operation described above and affords other features and advantages heretofore not obtainable.

SUMMARY OF THE INVENTION

It is an object of the present invention to provide a convenient homeowner's apparatus or tool for applying a liquid surface coating or sealer to a bituminous surface, such as a driveway, that requires periodic application of sealing material.

Another object of the invention is to provide an attachment that may be utilized in connection with a standard garden and lawn spreader normally used to spread granular fertilizer, seed, and the like, whereby the hopper of the spreader may be used to store and dispense the viscous liquid in droplet form for subsequent spreading and smoothing by the attachment of the invention.

The mobile hopper assembly has a slot at the bottom through which the liquid sealer is dispensed and also normally has a distributor bar that is turned by the axle for the hopper wheels in the vicinity of the slot to distribute the viscous sealant in the form of globules or droplets on the surface to be sealed. The hopper assembly has a handle connected on one side to enable an operator to pull it along a linear path.

In order to spread and level or smooth the droplets dispensed from the hopper, the attachment of the invention is connected to the hopper assembly and towed along behind to engage and spread the droplets or globules and also to smooth the material into a continuous surface coating. The spreading and leveling assembly is pivotally connected to the hopper so that it can readily follow a curved path of travel when desired. The assembly includes a frame, a flexible, resilient spreading blade mounted on the frame and closely spaced from the surface to be coated, and a flexible, resilient smoothing blade mounted on the frame behind the spreading blade to further smooth the spread material into a continuous surface coating.

The spreading blade has a V-shaped configuration with two arms joined centrally at about the line of travel and extending rearwardly and laterally to engage the globules or droplets in an angular manner relative to the path of travel. This serves to distribute the globules or droplets laterally as well as longitudinally relative to the direction of travel. The smoothing blade extends perpendicular to the line of travel, and engages the surface to smooth the material into a thin, continuous surface coating.

DESCRIPTION OF THE PREFERRED EMBODIMENT

Figure 1:
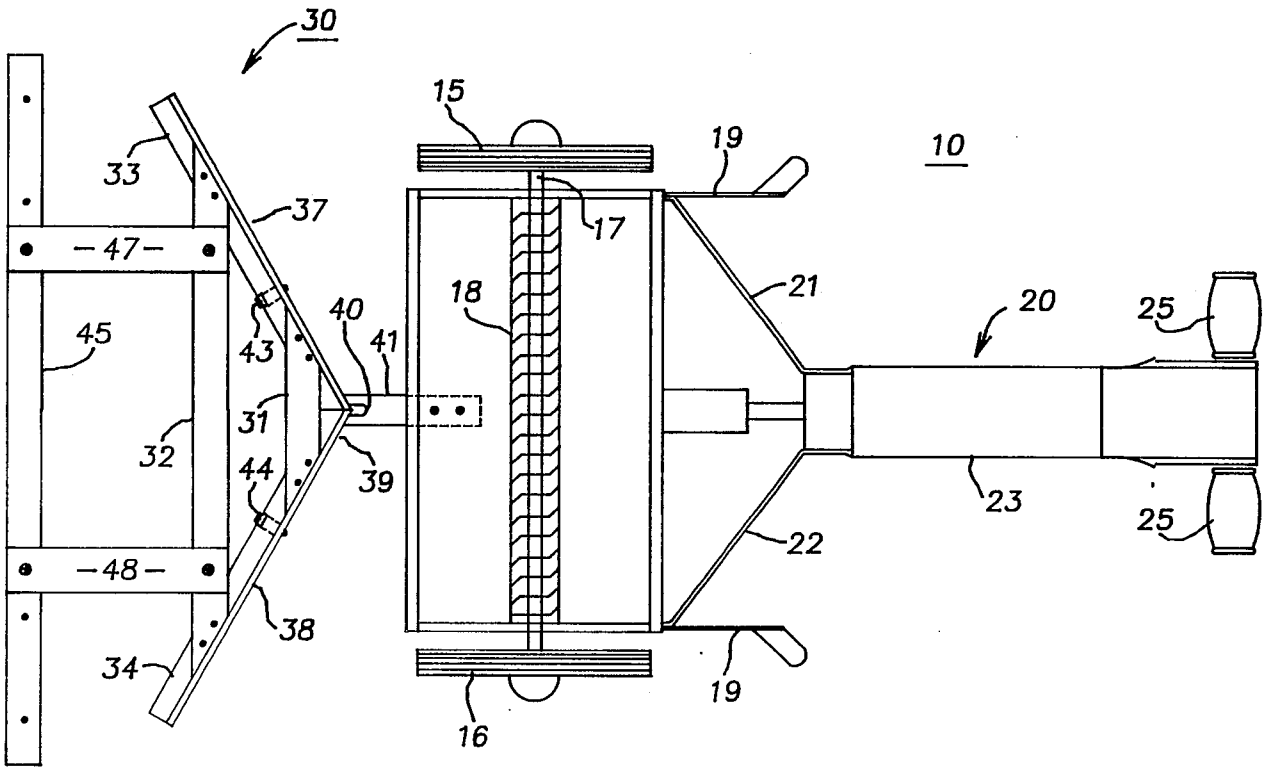
FIG. 1 is a plan view of an apparatus for applying liquid surface sealer in accordance with the invention.
Figure 2:
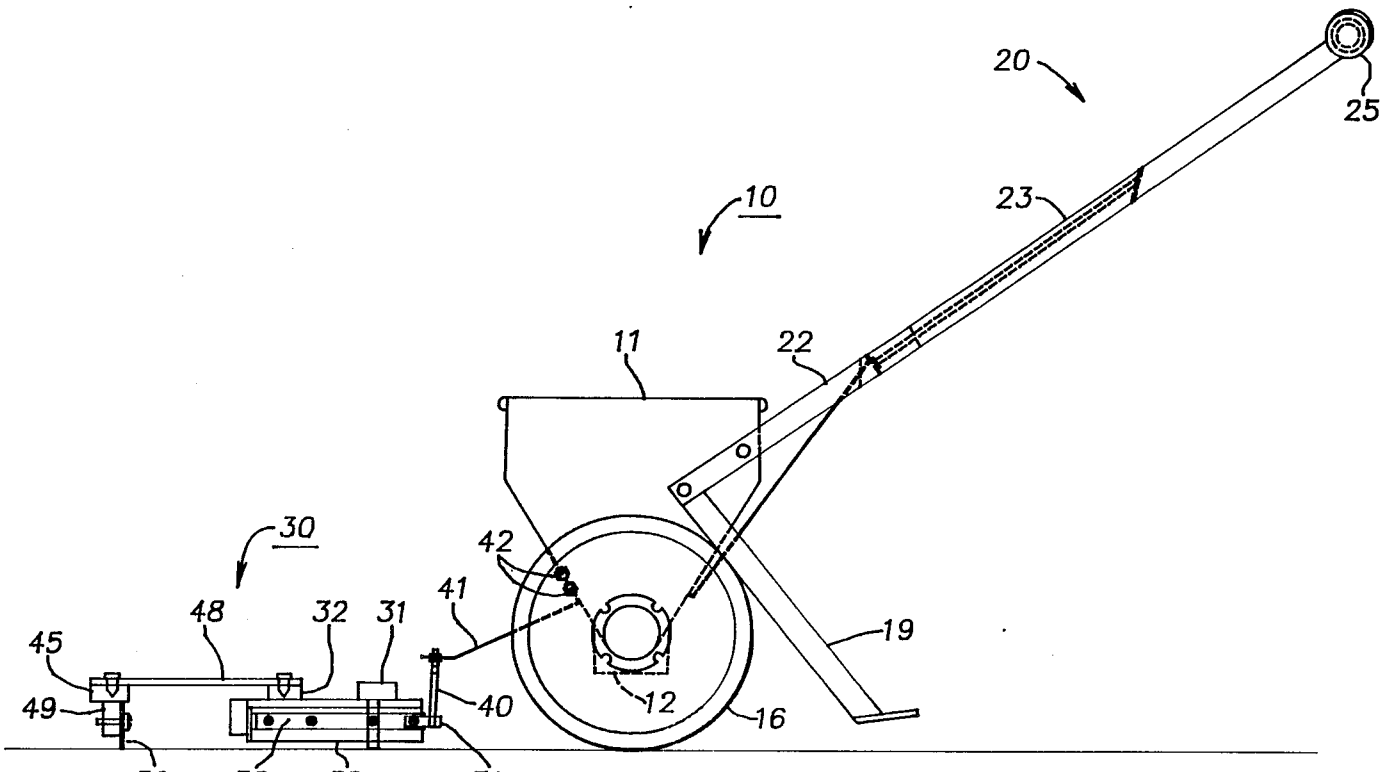
FIG. 2 is a side elevation of the apparatus of FIG. 1.
Figure 3:
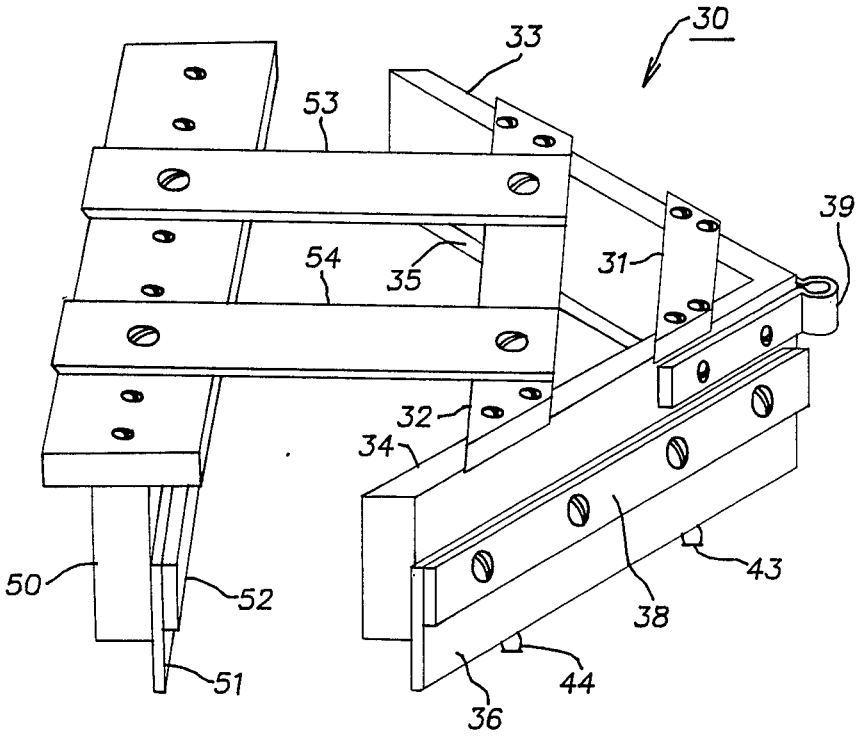
FIG. 3 is a perspective view showing the spreading and smoothing attachment forming part of the combination of the invention.

Referring more particularly to the drawings, there is shown a garden and lawn spreader 10 of conventional design, with a sealer-applicator attachment 30 embodying the invention associated therewith. The lawn spreader 10 may be, for example, the commercially available garden spreader sold under the trade designation "LAWN-BOY" by Outboard Marine Corporation of Waukegon, Ill. The spreader includes a hopper 11 with an outlet slot 12 at the bottom so that material may be distributed in a controlled manner by means of a gate 13 which controls the size of the slot through which material is dispensed. The spreader 10 has a pair of wheels 15 and 16 mounted on an axle 17 whereby one of the wheels is fixed to the axle and the other is journaled for free rotation. A ribbed distributor bar 18 is mounted on the axle 17 closely adjacent the slot 12 so that turning of the wheel 15 causes rotation of the distributor bar to assist in the dispensing of material from the hopper 11. When the hopper is not being pulled by an operator, it rests on the wheels 15 and 16 and on a pair of legs 19 which support it in a slightly tilted but generally upright position.

The hopper 11 also has a handle assembly 20 including a pair of brackets 21 and 22 riveted to the sides of the hopper and a tongue 23 supported by the brackets. A pair of hand grips 25 and 26 are located at the end of the tongue 23 to facilitate pulling of the hopper 11 by an operator. A control rod 27 mounted closely adjacent the grips 25 and 26 may be used to control the position of the gate 13, and thus to adjust the size of the slot 12.

In accordance with the invention, the hopper 11 is filled with a commercially available, water-based asphaltic driveway sealing compound, such as the compound sold under the trade designation "707 JET COAT". Because the material is water-based, it may be easily cleaned from the hopper 11 once the sealing operation is completed by use of a water hose and nozzle. It is not desirable to use oil-based asphlatic sealer, since cleanup is virtually impossible. The asphaltic compound that is dispensed from the hopper by means of the distributor bar and the slot 12 is generally in the form of droplets or globules which are deposited in a linear path as the hopper is pulled along the driveway in a desired pattern to accomplish the sealing operation.

In order to spread and smooth the globules to provide a continuous thin coating of sealant on the driveway or other bituminous surface, the special sealer-applicator attachment of the invention is provided for use in association with the hopper 11. The attachment includes a frame comprising a pair of spreader beams 31 and 32 located perpendicular to the line of travel of the hopper 11, a pair of angularly disposed blade supports 33 and 34 connected to the spreader beams 31 and 32, as best shown in FIG. 1, and a pair of spreader blades 35 and 36 attached to the blade supports 33 and 34, respectively, so that they have a V-shaped configuration and define about a 120-degree angle bisected by the longitudinal centerline of the attachment.

Accordingly, each of the blades 35 and 36 is angularly disposed relative to the line of travel, and thus as the hopper 11 is pulled forward, they tend to spread the droplets not only in a longitudinal path but also to some extent laterally to provide an optimum distribution of the droplets and globules in the zone in which they are dispensed through the slot 12.

The blades 35 and 36 are secured to the blade supports 33 and 34 by means of bars 37 and 38, respectively, which are attached by screws to the blade supports 33 and 34 with the blades 35 and 36 pressed therebetween. The mounting bars permit removal and replacement of the blades 35 and 36 when and if they become worn.

The blades 35 and 36 are preferably formed of a resilient elastomeric material such as vinyl or rubber so that they can be easily cleaned with water once the sealing operation has been completed, and also to provide desired flexibility, as irregularities, such as stones, cinders, pebbles, and the like, might be encountered during operation. "NEOPRENE" has been found to be particularly suitable.

The bottom edges of the blades 35 and 36 are spaced slightly above the surface to be coated by means of threaded spacer feet 43 and 44 and attached to the blade supports 33 and 34, respectively. The spacing may be adjusted by threading the spacer feet 43 and 44 into and out of their respective blade supports 33 and 34. However, the optimum spacing has been determined to be about ⅛ inch. The attachment 30 is connected to the hopper 11 by means of a bracket 39 connected at the apex of the blade supports 33 and 34, and which in turn is pivotally connected by a pivot pin 40 to a connector arm 41 that is bolted to the rearward wall of the hopper 11. The pivot pin 40 is oriented to define a generally vertical axis so that the attachment 30 may swivel relative to the longitudinal centerline of the hopper 11 to facilitate travel of the hopper and attachment 30 in a curved path.

Located to the rear of the spreader beam 32 is a smoother beam 50 to which a smoother blade 51 is attached by means of a mounting bar 52. The smoother beam 50 is connected to the spreader beam 32 by means of a pair of bars 53 and 54. The smoother blade 51 is adapted to engage the surface diectly and is not adapted to be spaced therefrom during operation. Accordingly, the smoother blade 51 engages the sealant in the relatively flat, discontinuous patches resulting from the operation of the spreader blades 35 and 36, and further distributes the material into a thin, continuous coating over the surface to be sealed. The blade 51 is preferably formed of the same material as the blades 35 and 36.

The combination of the present invention is particularly advantageous for use by a homeowner with a driveway or walkway that must be periodically sealed, and who may also own, or at least be able to utilize, a lawn and garden spreader. In order to achieve the advantages of the invention, he need merely obtain a sealer-applicator attachment and thus utilize an item of equipment already maintained for a variety of outdoor maintenance purposes other than driveway or walkway sealing.

It has been found also that the device of the invention is particularly advantageous for use by individuals who are unable to accomplish the sealing using the customary practice of manually applying the material from a bucket using a mop, broom, brush, etc., and thus requiring extensive physical exertion. In the case of pesons with neither the time nor the physical strength to accomplish this by hand, the device of the present invention provides an excellent solution as well as superior results compared to the results obtained from manual application.

For example, it has been found that the time required to coat and seal a driveway may be reduced to 25% of the time required for manual operation. It is, of course, extremely desirable that a water-based compound be used, or otherwise the lawn spreader would be rendered unusable for normal lawn and garden purposes.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. Apparatus for spreading and leveling liquid surface coatings on a generally level surface including in combination:

a mobile hopper for dispensing at a controlled rate a viscous coating liquid along the path of travel of the hopper in the form of globules and droplets, and a spreading and leveling attachment pivotally connected to and adapted to be towed by said hopper, said attachment comprising:

a frame;

a flexible resilient spreading blade mounted on said frame closely spaced from the surface to be coated and having a pair of arms angularly disposed relative to one another and intersecting to define an apex at approximately the centerline of said path of travel, said apex extending toward the direction of travel and said arms defining an angle bisected by said centerline whereby said arms spread and flatten said globules and droplets on said surface in both longitudinal and laterally outward directions in a band over a portion of the surface to be coated; and a flexible resilient smoothing blade mounted on said frame and spaced rearwardly from said spreading blade relative to said path of travel and having a width greater than the span defined by said arms, said smoothing blade being engageable with said surface to smooth said viscous liquid that has been spread and flattened by said spreading blade into a thin continuous coating that is greater in width than the span between the outer ends of said spreading blade.

2. Apparatus as defined in claim 1, wherein said spreading blade and said smoothing blade are formed of an elastomeric material.

3. Apparatus as defined in claim 1, wherein said length portions define an angle of intersection of about 120° C.

* * * * *